US010446089B2

(12) United States Patent
Zha

(10) Patent No.: US 10,446,089 B2
(45) Date of Patent: Oct. 15, 2019

(54) METHOD, SYSTEM AND COMPUTER READABLE STORAGE MEDIUM FOR DRIVING LIQUID CRYSTAL DISPLAYS

(71) Applicant: Wuhan China Star Optoelectronics Technology Co., Ltd., Wuhan, Hubei (CN)

(72) Inventor: Guowei Zha, Hubei (CN)

(73) Assignee: WUHAN CHINA STAR OPTOELECTRONICS TECHNOLOGY CO., LTD., Wuhan (CN)

( * ) Notice: Subject to any disclaimer, the term of this patent is extended or adjusted under 35 U.S.C. 154(b) by 0 days.

(21) Appl. No.: 15/578,320

(22) PCT Filed: Oct. 31, 2017

(86) PCT No.: PCT/CN2017/108688

§ 371 (c)(1),
(2) Date: Nov. 30, 2017

(87) PCT Pub. No.: WO2019/061654

PCT Pub. Date: Apr. 4, 2019

(65) Prior Publication Data

US 2019/0114973 A1 Apr. 18, 2019

(30) Foreign Application Priority Data

Sep. 26, 2017 (CN) ..... 2017 1 0884863

(51) Int. Cl.
*G09G 3/34* (2006.01)
*G09G 3/36* (2006.01)

(52) U.S. Cl.
CPC ..... *G09G 3/3406* (2013.01); *G09G 3/3607* (2013.01); *G09G 2320/0252* (2013.01);
(Continued)

(58) Field of Classification Search
CPC .. G09G 3/3406; G09G 3/3607; G09G 3/3426; G09G 3/342; G09G 3/2003; G09G 3/3413; G09G 3/2025
(Continued)

(56) References Cited

U.S. PATENT DOCUMENTS 7,852,432 B2 * 12/2010 Li ..... G02F 1/133609 345/102
9,159,273 B2 * 10/2015 Katsu ..... G09G 3/3426
(Continued)

FOREIGN PATENT DOCUMENTS

CN 101021639 A 8/2007
CN 101211537 A 7/2008
(Continued)

*Primary Examiner* — Fred Tzeng
(74) *Attorney, Agent, or Firm* — Hemisphere Law, PLLC; Zhigang Ma

(57) ABSTRACT

A method for driving the liquid crystal display comprises dividing a screen of the liquid crystal display into multiple displaying regions, and performing a divisional driving thereto, setting a backlight parameter corresponding to each the displaying region to a first backlight parameter during a first half of a time period of one frame, wherein the first backlight parameter is smaller than or equal to a maximum backlight parameter, setting the backlight parameter to a second backlight parameter during a second half of the time period, wherein the second parameter is smaller than a first threshold value, to have a default frame inserted during the second half of the time period of the one frame, and a difference between a gray level of the default frame and a gray level of a full black frame is within a predetermined range. The technical solution can improve blurred pictures.

15 Claims, 3 Drawing Sheets

(52) U.S. Cl.
CPC ..... *G09G 2320/0261* (2013.01); *G09G 2320/064* (2013.01); *G09G 2320/0646* (2013.01); *G09G 2320/0686* (2013.01); *G09G 2360/16* (2013.01)

(58) Field of Classification Search
USPC ..... 345/691
See application file for complete search history.

(56) References Cited

U.S. PATENT DOCUMENTS

2007/0057900 A1 3/2007 Huang
2008/0284719 A1* 11/2008 Yoshida ..... G02F 1/136277 345/102
2009/0289968 A1* 11/2009 Yoshida ..... G09G 3/2025 345/691
2010/0321414 A1* 12/2010 Muroi ..... G09G 3/3413 345/690
2011/0057961 A1* 3/2011 Tsuru ..... G09G 3/342 345/690
2011/0122170 A1* 5/2011 Kim ..... G09G 3/3406 345/690
2012/0002050 A1* 1/2012 Taniguchi ..... H04N 7/181 348/148
2012/0092386 A1* 4/2012 Wu ..... G09G 3/3406 345/690
2012/0293400 A1* 11/2012 Matsubayashi ..... G09G 3/3406 345/88
2013/0321490 A1* 12/2013 Clark ..... G09G 3/3406 345/690
2015/0055025 A1* 2/2015 Gotoh ..... G09G 3/3426 348/790
2016/0260390 A1* 9/2016 Diao ..... G09G 3/3406
2016/0307523 A1* 10/2016 Huang ..... G09G 3/3607
2017/0301298 A1* 10/2017 Wang ..... G09G 3/2003
2017/0345379 A1* 11/2017 Guo ..... G09G 3/3406
2018/0069999 A1* 3/2018 Zhou ..... G06T 7/11
2018/0090082 A1* 3/2018 Zhang ..... G09G 3/3607
2018/0218690 A1* 8/2018 Zhou ..... G09G 3/3406
2018/0261170 A1* 9/2018 Shiomi ..... G02F 1/133

FOREIGN PATENT DOCUMENTS

CN 101271676 A 9/2008
CN 101315748 A 12/2008
CN 102298908 A 12/2011
CN 104050931 A 9/2014

* cited by examiner

METHOD, SYSTEM AND COMPUTER READABLE STORAGE MEDIUM FOR DRIVING LIQUID CRYSTAL DISPLAYS

RELATED APPLICATIONS

The present application is a National Phase of International Application Number PCT/CN2017/108688, filed Oct. 31, 2017, and claims the priority of China Application No. 201710884863.3, filed Sep. 26, 2017.

FIELD OF THE DISCLOSURE

The disclosure relates to a display technical field, and more particularly to a method, a system and a computer readable storage medium for driving liquid crystal displays.

BACKGROUND

The development of display terminal is transited from simply showing pictures to displaying videos. Following the rapid developments of stream media these years, people put forward the higher requirement to the video quality of display devices. On the conventional basis of pursuing quality resolution, color reproduction and contrast, a new technical requirement for video playback is demanded to reproduce the moving pictures. One of the important aspects is to improve motion blur. The motion blur is caused fundamentally by the limited response time of the display devices and the characteristics of visual tracking and spatial resolution of human vision. When adjacent frames display a high speed of moving object, a certain of visual trailing will occur because the response time of liquid crystal is far longer than the switching time of frames.

SUMMARY

The present invention provides a method, a system and a computer readable storage medium, for driving a liquid crystal display, to improve blurred pictures when the moving frames are displayed on the liquid crystal display.

In the first respect, the embodiment of the present invention provides a method for driving the liquid crystal display. The method of driving the liquid crystal display comprises:

dividing a screen of the liquid crystal display into multiple displaying regions and performing a divisional driving to the multiple displaying regions;

during a first half of a time period of one frame displayed by the liquid crystal display, setting a backlight parameter corresponding to each the displaying region of the liquid crystal display to a first backlight parameter, wherein the first backlight parameter is smaller than or equal to a maximum backlight parameter of the each displaying region of the liquid crystal display;

during a second half of the time period of the one frame displayed by the liquid crystal display, setting the backlight parameter corresponding to each the displaying region of the liquid crystal display to a second backlight parameter, wherein the second parameter is smaller than a first threshold value, to have a default frame inserted during the second half of the time period of the one frame displayed by the liquid crystal display, and a difference between a gray level of the default frame and a gray level of a full black frame is within a predetermined range.

The predetermined range is zero or almost zero, to have a full black or almost full black frame inserted during the second half of the time period of the one frame, thereby to perform the black frame insertion (BFI), for improving the blurred picture issue when the moving frames are displayed on the liquid crystal display.

In the second respect, a system for driving the liquid crystal displays is provided. The system for driving the liquid crystal displays comprises;

a dividing module, for dividing a screen of the liquid crystal display into multiple displaying regions and performing a divisional driving to the multiple displaying regions;

a first setting module, for setting a backlight parameter of each displaying region of the liquid crystal display to a first backlight parameter, during a first half of a time period of one frame displayed by the liquid crystal display, wherein the first backlight parameter is smaller than or equal to a maximum backlight parameter of the each displaying region of the liquid crystal display.

a second setting module, for setting the backlight parameter corresponding to each the displaying region of the liquid crystal display to a second backlight parameter, during a second half of the time period of the one frame displayed by the liquid crystal display, wherein the second parameter is smaller than a first threshold value, to have a default frame inserted during the second half of the time period of the one frame displayed by the liquid crystal display, and a difference between a gray level of the default frame and a gray level of a full black frame is within a predetermined range.

In the third respect, a computer readable storage medium with a program for driving the liquid crystal display stored therein is provided. The program is executed to perform the method provided in the first respect.

In the fourth respect, a computer program product is provided. The computer program product comprises a non-instantaneous computer readable storage medium for storing a computer program. The computer program is executed to have a computer perform the method provided in the first respect.

The embodiments of present invention have the following advantages.

Apparently, the divisional driving for the liquid crystal display is applied to set the first backlight parameter and the second backlight parameter at the same time in the embodiments of the present invention, to insert a full black or almost full black frame during the second half of the time period of the one frame, thereby to perform the black frame insertion, for improving the blurred picture issue when the moving frames are displayed on the liquid crystal displays.

BRIEF DESCRIPTION OF THE DRAWINGS

Accompanying drawings are for providing further understanding of embodiments of the disclosure. The drawings form a part of the disclosure and are for illustrating the principle of the embodiments of the disclosure along with the literal description. Apparently, the drawings in the description below are merely some embodiments of the disclosure, a person skilled in the art can obtain other drawings according to these drawings without creative efforts. In the figures.

DETAILED DESCRIPTION OF PREFERRED EMBODIMENTS

Figure 1:
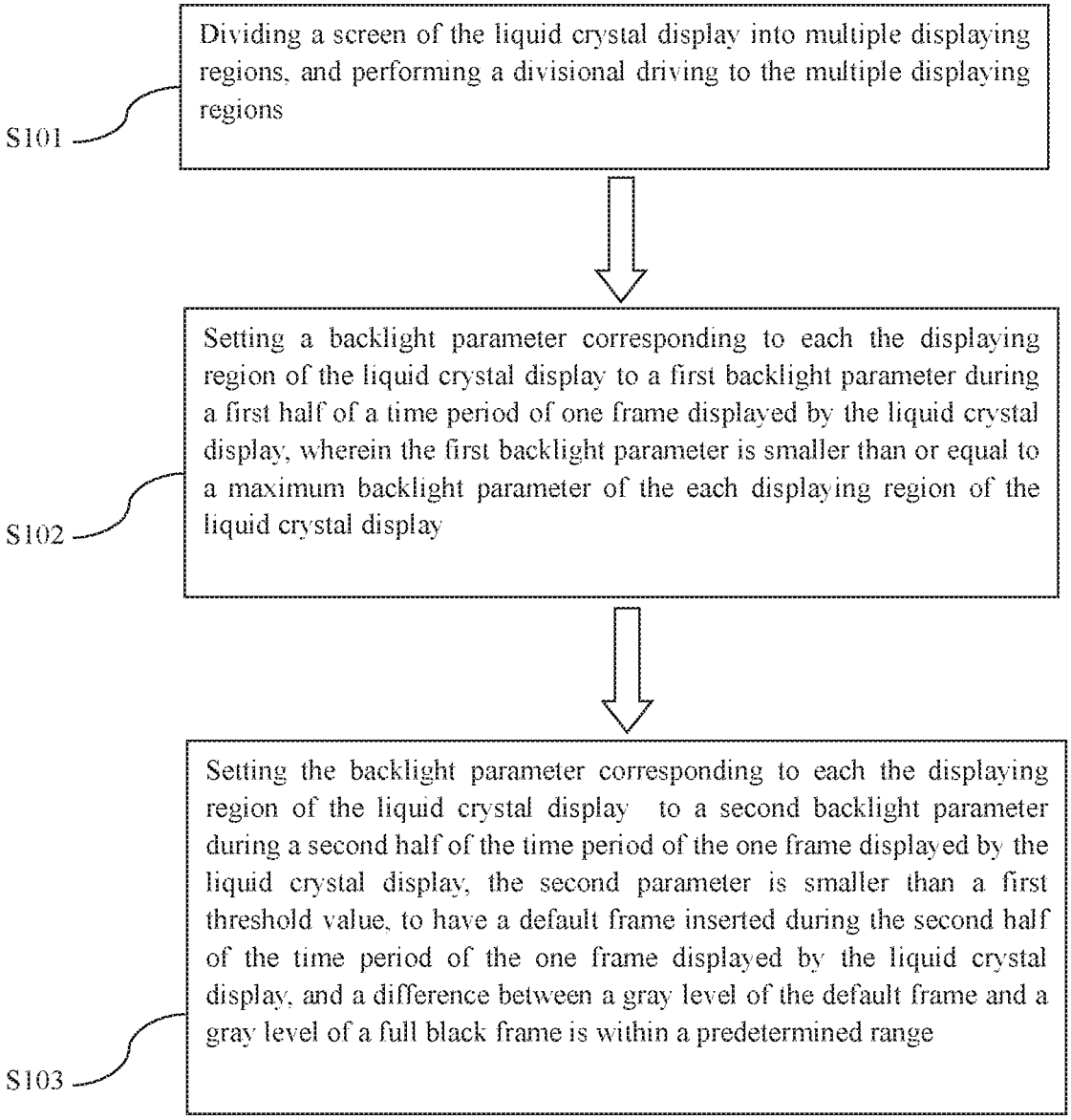
FIG. 1 is a flowing chart illustrating the steps of a method for driving a liquid crystal display in an embodiment of the present invention.

The disclosure will be further described in detail with reference to accompanying drawings and preferred embodiments as follows. The specific structural and functional details disclosed herein are only representative and are intended for describing exemplary embodiments of the disclosure. However, the disclosure can be embodied in many forms of substitution, and should not be interpreted as merely limited to the embodiments described herein. All other embodiments obtained by persons of ordinary skill in the art based on the embodiments of the present invention without creative efforts shall fall within the protection scope of the present invention.

The terms "first", "second", etc., in specification, claims and drawings of the invention, are used to distinguish between different objects, rather than describe a specific order. Furthermore, the terms "including" and "having", and any modification thereof, are intended to cover non-exclusive inclusion. For example, a process, a method, a system, a product or an apparatus comprising a series of steps or units are not limited to the listed steps or units, but optionally further comprises more steps or units not listed, or optionally further comprises other inherent steps or units belong to such the process, the method, the product or the apparatus.

Reference herein to "one embodiment", "an embodiment", or "another embodiment" herein, means that a particular feature, structure, operation, or characteristic described in connection with the embodiment, is included in at least one embodiment of the present invention. Thus, the appearances of such phrases or formulations herein are not necessarily all referring to the same embodiment. Furthermore, various features, structures, operations, or characteristics may be combined in any suitable manner in one or more embodiments.

For solving the above deficiency issues in operation, the present invention provides a method for driving the liquid crystal display. Specifically, in an embodiment, the method for driving the liquid crystal display comprises but not limited to the following steps.

Step S101 is dividing a screen of the liquid crystal display into multiple displaying regions, and performing a divisional driving to the multiple displaying regions.

Step S102 is setting a backlight parameter corresponding to each the displaying region of the liquid crystal display to a first backlight parameter, during a first half of a time period of one frame displayed by the liquid crystal display. The first backlight parameter is smaller than or equal to a maximum backlight parameter of the each displaying region of the liquid crystal display.

In one embodiment, multiple the backlight parameter corresponding to each the displaying region of the liquid crystal display may be equal or not equal.

Optionally, the step of setting the backlight parameter corresponding to each the displaying region of the liquid crystal display to the first backlight parameter, further comprises counting a distribution situation of a gray level of each the displaying region of the liquid crystal display, and determining the backlight parameter corresponding to each the displaying region of the liquid crystal display according to the distribution situation of the gray level of each the displaying region.

Optionally, the backlight parameter corresponding to each the displaying region of the liquid crystal display is determined according to a maximum gray level, a minimum gray level, an average gray level and a most distributed gray level of each the displaying region.

Optionally, the backlight parameter corresponding to each the displaying region of the liquid crystal display is determined according to a maximum gray level, a minimum gray level, a weighted value of an average gray level and a most distributed gray level of each the displaying region.

Step S103 is setting the backlight parameter corresponding to each the displaying region of the liquid crystal display to a second backlight parameter, during a second half of the time period of the one frame displayed by the liquid crystal display. The second parameter is smaller than a first threshold value, to have a default frame inserted during the second half of the time period of the one frame displayed by the liquid crystal display, and a difference between a gray level of the default frame and a gray level of a full black frame is within a predetermined range.

In one embodiment, the first half and the second half of the time period of one frame are equal.

In one embodiment, the first threshold value is almost zero, and the predetermined range is zero or almost zero, to have a full black or almost full black frame inserted during the second half of the time period of the one frame, thereby to perform the black frame insertion (BFI).

Optionally, the step of setting the backlight parameter corresponding to each the displaying region of the liquid crystal display to the second backlight parameter, further comprises counting a distribution situation of a gray level of each the displaying region of the liquid crystal display, and determining the backlight parameter corresponding to each the displaying region of the liquid crystal display according to the distribution situation of the gray level of each the displaying region.

Optionally, the backlight parameter corresponding to each the displaying region of the liquid crystal display is determined according to a maximum gray level, a minimum gray level, an average gray level and a most distributed gray level of each the displaying region.

Optionally, the backlight parameter corresponding to each the displaying region of the liquid crystal display is determined according to a maximum gray level, a minimum gray level, a weighted value of an average gray level and a most distributed gray level of each the displaying region.

For example, the screen of the liquid crystal display is divided into multiple displaying regions, and the divisional driving is performed to drive the multiple displaying regions. A gray level of one frame displayed by the liquid crystal display is obtained. The gray level includes a height, a width and values of the gray level of three channels R/G/B, and constitutes a matrix of gray levels, gray (height, width, R/G/B). The matrix of gray levels, gray (height, width, R/G/B), is normalized according to an electric light curve. A Gamma curve is used to normalize the matrix of gray levels, gray (height, width, R/G/B). Then, a number distribution of the gray levels in each displaying region is counted. For example, the number distribution of the gray levels is Hist(gray, n), $n \in [1, N]$, N is the number of regions of the backlight, $gray \in [0, 2^{Bit}-1]$, Bit is the number of bits of the gray level, such as 8 bit, 10 bit, etc. The backlight parameter Blu(n) corresponding to each the displaying region is determined according to the maximum gray level, the minimum gray level, the average gray level and the most distributed gray level of each the displaying region. The backlight of one frame is performed twice changes, $$\text{when } t \in (0, T/2),$$

$$\text{First backlight parameter} = \begin{cases} 2^{*}Blu(n) & \text{when } Blu(n) < \text{Blu_max}/2; \\ \text{Blu_max} & \text{when } Blu(n) \geq \text{Blu_max}/2; \end{cases}$$

$$\text{when } t \in (T/2, T),$$

$$\text{second backlight parameter} = \begin{cases} 0 & \text{when } Blu(n) < \text{Blu_max}/2; \\ 2^{*}Blu(n) - \text{Blu_max} & \text{when } Blu(n) \geq \text{Blu_max}/2; \end{cases}$$

wherein, the Blu_max is the maximum backlight parameter, T is the time period of one frame.

During the first half of the time period of one frame displayed by the liquid crystal display, if the backlight parameter Blu(n) corresponding to a displaying region of the liquid crystal display is smaller than Blu_max/2, the first backlight parameter is set to 2*Blu(n), and at this time the first backlight parameter is smaller than the maximum backlight parameter, so the backlight parameter according to the displaying region is adjusted to the first backlight parameter 2*Blu(n). If the backlight parameter Blu(n) corresponding to a displaying region of the liquid crystal display is larger than or equal to Blu_max/2, the first backlight parameter is set to Blu_max, and the backlight parameter according to the displaying region is adjusted to the first backlight parameter Blu_max.

During the second half of the time period of one frame displayed by the liquid crystal display, if the backlight parameter Blu(n) corresponding to a displaying region of the liquid crystal display is smaller than Blu_max/2, the second backlight parameter is set to zero, and the backlight parameter according to the displaying region is adjusted to the second backlight parameter, zero, for performing the black frame insertion. If the backlight parameter Blu(n) corresponding to a displaying region of the liquid crystal display is larger than or equal to Blu_max/2, the second backlight parameter is set to 2*Blu(n)−Blu_max, and at this time the second backlight parameter is almost zero. Then, the backlight parameter according to the displaying region is adjusted to 2*Blu(n)−Blu_max, to insert an almost black frame.

In the technical solutions provided by the present invention, the divisional driving for the liquid crystal display is applied to set the first backlight parameter and the second backlight parameter at the same time, to insert a full black or almost full black frame during the second half of the time period of the one frame, thereby to perform the black frame insertion, for improving the blurred picture issue when the moving frames are displayed on the liquid crystal displays.

Optionally, the method for driving the liquid crystal display further comprises a step of performing a brightness compensation to each the gray level of the liquid crystal display, according to the backlight parameter corresponding to each the displaying region of the liquid crystal display and a brightness of each pixel of the liquid crystal display at the backlight parameter.

Optionally; B2 is calculated according to an equation of A1*B1=A2*B2. The A1 is the brightness of each the pixel at a full backlight of the liquid crystal display, the B1 is a normalized brightness of each the pixel at the full backlight of the liquid crystal display, the A2 is the brightness of each the pixel of the liquid crystal display at the current backlight parameter; the B2 is the normalized brightness of each the pixel of the liquid crystal display at the current backlight parameter, wherein the B1 is obtained according to the distribution situation of the gray level of each the displaying region at the full backlight of the liquid crystal display;

The method for driving the liquid crystal display further comprises a step of obtaining the gray level of each the pixel of the liquid crystal display at the current backlight parameter according to the B2, and driving the liquid crystal display according to the gray level of each the pixel of the liquid crystal display at the current backlight parameter.

This technical solution can improve the issue of brightness decreasing of an image due to the black frame insertion. Thus, the brightness decreasing of the image can be compensated to a certain degree, thereby to improve blurred pictures when the moving frames are displayed on the liquid crystal display.

Figure 2:
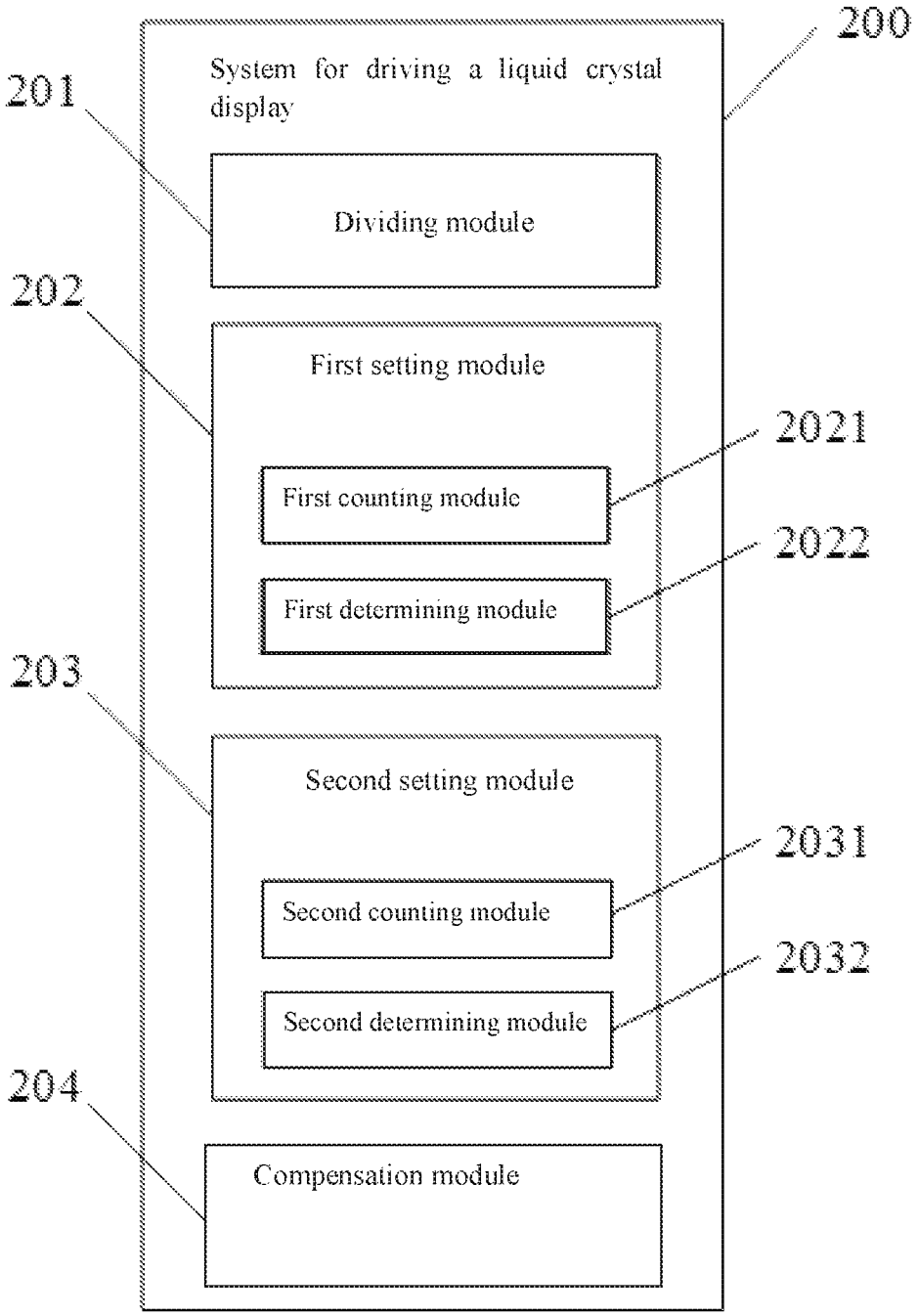
FIG. 2 is a structure scheme of a system for driving a liquid crystal display in an embodiment of the present invention.

As shown in FIG. 2, a system 200 for driving the liquid crystal display comprising a dividing module 201, a first setting module 202 and a second setting module 203 is provided. The specific functions of each module are depicted as follows.

A dividing module 201 is for dividing a screen of the liquid crystal display into multiple displaying regions, and performing a divisional driving to the multiple displaying regions.

A first setting module 202 is for setting a backlight parameter corresponding to each displaying region of the liquid crystal display to a first backlight parameter, during a first half of a time period of one frame displayed by the liquid crystal display. The first backlight parameter is smaller than or equal to a maximum backlight parameter corresponding to the each displaying region of the liquid crystal display.

A second setting module 203, for setting the backlight parameter of each the displaying region corresponding to the liquid crystal display to a second backlight parameter, during a second half of the time period of the one frame displayed by the liquid crystal display. The second factor is smaller than a first threshold value, to have a default frame inserted during the second half of the time period of the one frame displayed by the liquid crystal display, and a difference between a gray level of the default frame and a gray level of a full black frame is within a predetermined range.

In one embodiment, multiple the backlight parameter corresponding to each the displaying region of the liquid crystal display may be equal or not equal.

In one embodiment, the first half and the second half of the time period of one frame are equal.

In one embodiment, the first threshold value is almost zero, and the predetermined range is zero or almost zero, to have a full black or almost full black frame inserted during the second half of the time period of the one frame, thereby to perform the black frame insertion.

Optionally, the first setting module 202 comprises a first counting module 2021 and a first determining module 2022.

The first counting module 2021 is for counting a distribution situation of the gray level of each the displaying region of the liquid crystal display.

The first determining module 2022 is for determining the backlight parameter corresponding to each the displaying region, according to the distribution situation of the gray level of each the displaying region of the liquid crystal display.

Optionally, the first determining module 2022 determines the backlight parameter corresponding to each the displaying region, according to the maximum gray level, the minimum gray level, the average gray level and the most distributed gray level of each the displaying region.

Optionally, the backlight parameter corresponding to each the displaying region of the liquid crystal display is determined according to the maximum gray level, the minimum gray level, the weighted value of the average gray level and the most distributed gray level of each the displaying region.

Optionally, the second setting module 203 comprises a second counting module 2031 and a second determining module 2032.

The second counting module 2031 is for counting a distribution situation of the gray level of each the displaying region of the liquid crystal display.

The second determining module 2032 is for determining the backlight parameter corresponding to each the displaying region, according to the distribution situation of the gray level of each the displaying region of the liquid crystal display.

Optionally, the second determining module 2032 determines the backlight parameter corresponding to each the displaying region, according to the maximum gray level, the minimum gray level, the average gray level and the most distributed gray level of each the displaying region.

Optionally, the backlight parameter corresponding to each the displaying region of the liquid crystal display is determined according to the maximum gray level, the minimum gray level, the weighted value of the average gray level and the most distributed gray level of each the displaying region.

For example, the dividing module 201 is applied to divide the screen of the liquid crystal display into multiple displaying regions, and the divisional driving is performed to drive the multiple displaying regions. A gray level of one frame displayed by the liquid crystal display is obtained. The gray level includes a height, a width and values of the gray level of three channels R/G/B, and constitutes a matrix of gray levels, gray (height, width, R/G/B). The matrix of gray levels, gray (height, width, R/G/B), is normalized according to an electric light curve. A Gamma curve is used to normalize the matrix of gray levels, gray (height, width, R/G/B). Then, the first counting module 2021 and the second counting module 2031 are applied to count a number distribution of the gray levels in each displaying region. For example, the number distribution of the gray levels is Hist(gray, n), n∈[1, N], N is the number of regions of the backlight, gray∈[0, 2^Bit−1], Bit is the number of bits of the gray level, such as 8 bit, 10 bit, etc. The first determining module 2022 and the second determining module 2032 are applied to determine the backlight parameter Blu(n) corresponding to each the displaying region, according to the maximum gray level, the minimum gray level, the average gray level and the most distributed gray level of each the displaying region. The backlight of one frame is performed twice changes, $$\text{when } t \in (0, T/2), \text{ when } t \in (0, T/2),$$

$$\text{First backlight parameter} = \begin{cases} 2^{*}Blu(n) & \text{when } Blu(n) < \text{Blu_max}/2; \\ \text{Blu_max} & \text{when } Blu(n) \geqslant \text{Blu_max}/2; \end{cases}$$

$$\text{when } t \in (T/2, T),$$

$$\text{second backlight parameter} = \begin{cases} 0 & \text{when } Blu(n) < \text{Blu_max}/2; \\ 2^{*}Blu(n) - \text{Blu_max} & \text{when } Blu(n) \geqslant \text{Blu_max}/2; \end{cases}$$

wherein, the Blu_max is the maximum backlight parameter, T is the time period of one frame.

During the first half of the time period of one frame displayed by the liquid crystal display, if the backlight parameter Blu(n) corresponding to a displaying region of the liquid crystal display is smaller than Blu_max/2, the first setting module 202 sets the first backlight parameter to 2*Blu(n), and at this time the first backlight parameter is smaller than the maximum backlight parameter, so the backlight parameter according to the displaying region is adjusted to the first backlight parameter 2*Blu(n). If the backlight parameter Blu(n) corresponding to a displaying region of the liquid crystal display is larger than or equal to Blu_max/2, the first setting module 202 sets the first backlight parameter to Blu_max, and the backlight parameter according to the displaying region is adjusted to the first backlight parameter Blu_max.

During the second half of the time period of one frame displayed by the liquid crystal display, if the backlight parameter Blu(n) corresponding to a displaying region of the liquid crystal display is smaller than Blu_max/2, the second setting module 203 sets the second backlight parameter to zero, and the backlight parameter according to the displaying region is adjusted to the second backlight parameter, zero, for performing the black frame insertion. If the backlight parameter Blu(n) corresponding to a displaying region of the liquid crystal display is larger than or equal to Blu_max/2, the second setting module 203 sets the second backlight parameter to 2*Blu(n)−Blu_max, and at this time the second backlight parameter is almost zero. Then, the backlight parameter according to the displaying region is adjusted to 2*Blu(n)−Blu_max, to insert an almost black frame.

The divisional driving for the liquid crystal display is applied to set the first backlight parameter and the second backlight parameter at the same time in the embodiments of the present invention, to insert a full black or almost full black frame during the second half of the time period of the one frame, thereby to perform the black frame insertion, for improving the blurred picture issue when the moving frames are displayed on the liquid crystal displays.

Optionally, the system 200 for driving the liquid crystal display further comprises a compensation module 204.

The compensation module 204 is performing a brightness compensation to each the gray level of the liquid crystal display, according to the backlight parameter corresponding to each the displaying region of the liquid crystal display and a brightness of each pixel of the liquid crystal display at the current backlight parameter.

Optionally, the compensation module 204 calculates B2 according to the equation of A1*B1=A2*B2.

The A1 is the brightness of each the pixel at a full backlight of the liquid crystal display, the B1 is a normalized brightness of each the pixel at the full backlight of the liquid crystal display, the A2 is the brightness of each the pixel of the liquid crystal display at the current backlight parameter, the B2 is the normalized brightness of each the pixel of the liquid crystal display at the current backlight parameter, wherein the B1 is obtained according to the distribution situation of the gray level of each the displaying region at the full backlight of the liquid crystal display.

The method for driving the liquid crystal display further comprises a step of obtaining the gray level of each the pixel of the liquid crystal display at the current backlight parameter according to the B2, and driving the liquid crystal display according to the gray level of each the pixel of the liquid crystal display at the current backlight parameter.

This technical solution can improve the issue of brightness decreasing of an image due to the black frame insertion.

Thus, the brightness decreasing of the image can be compensated to a certain degree, thereby to improve blurred pictures when the moving frames are displayed on the liquid crystal display.

The embodiments in the present invention also provide a computer readable storage medium with a program for driving the liquid crystal display stored therein. The program is executed to perform a part or all of the steps of any method for driving the liquid crystal display depicted in above embodiments.

The embodiments in the present invention also provide a computer program product with a program for driving the liquid crystal display stored therein. The computer program product executes the program to perform all or a part of the steps of any method for driving the liquid crystal display depicted in above embodiments.

Figure 3:
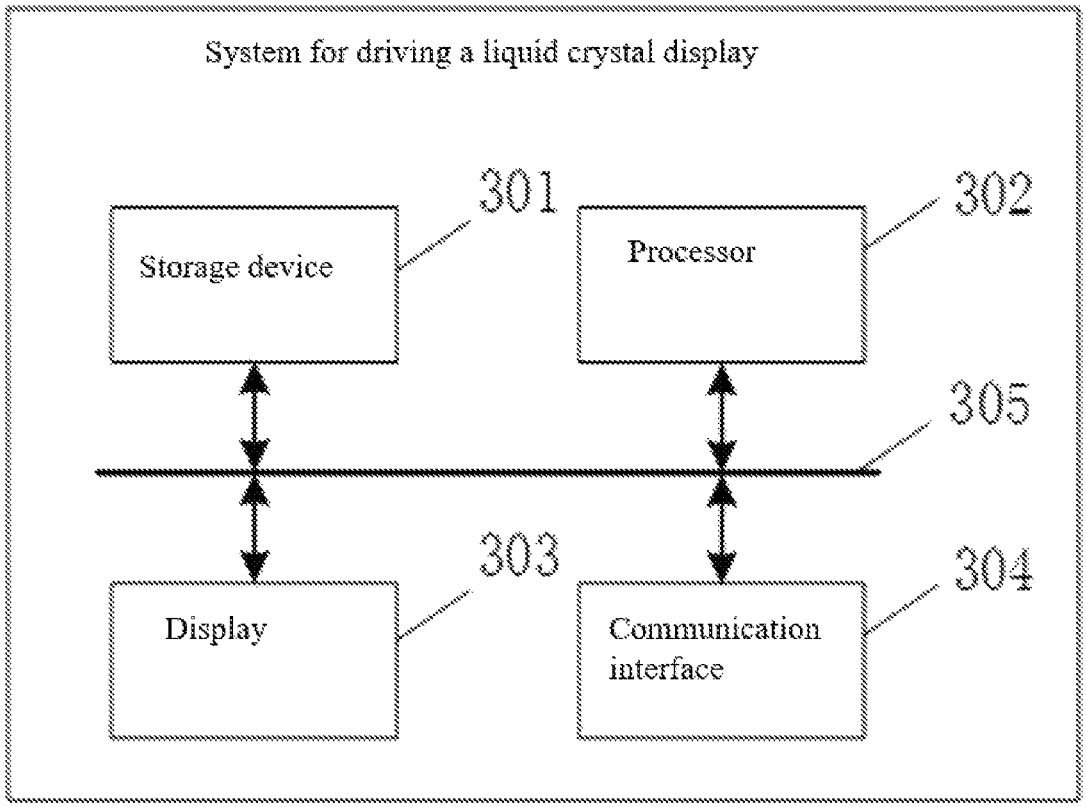
FIG. 3 is a structure scheme of another system for driving a liquid crystal display in an embodiment of the present invention.

As shown in FIG. 3, a structure scheme of a system for driving the liquid crystal display involved in the above embodiments is provided. The system for driving the liquid crystal display 300 comprises a storage device 301, a processor 302, a display 303, a communication interface 304 and a bus 305. The processor 302 is applied to run or execute the procedures illustrated in FIG. 1. The storage device 301, the processor 302, the display 303 and the communication interface 304 are all connected to the bus 305. The bus 305 may be a PCI (Peripheral Component Interconnect) bus, a EISA (Extension Industry Standard Architecture) bus and the like. The bus 305 may be divided into an address bus, a data bus, a control bus and the like. For illustrating conveniently, the bus is represented by only one thick line in FIG. 3, however, it does not mean there is only one bus or only one type of bus.

Those with ordinary skill in the art may understand that all or part of the procedure of the above embodiments can be fulfilled through relevant hardware instructed by a computer program. The program may be stored in a computer readable storage medium. When the program is executed, the procedures including the foregoing method illustrated in embodiments would be performed. The storage medium may be a magnetic disk, an optical disk, read-only memory (ROM) or a random-access memory (RAM) and the like.

It should be noted, for briefly describing, the foregoing method embodiments or examples are described as a series combination of actions. However, those skilled in the art should understand that the present invention is not limited by the described operation sequence, because according to the present invention some steps may be performed simultaneously or in other sequences. Secondly, those skilled in the art should also know that, all the exemplary embodiments described in the specification are optional, and the actions and units involved are not necessarily required by the present invention.

In the above embodiments, the descriptions of the various embodiments have different emphases, certain embodiments not detailed in part can be understood by referring to related descriptions in other embodiments.

In the embodiments provided by the present invention, it could be understood that the disclosed system, apparatus and method may be implemented in other ways. For example, the described system embodiments are merely illustrative, the unit division is merely logical function division, there may be other division in actual implementation. For example, a plurality of units or components may be combined, or be integrated into another system, or some features may be ignored or not performed. Besides, coupling, direct coupling or communication between interconnected may be through some interface, device, or unit, and which may be electrical, mechanical, or other forms.

The unit is described as separated parts may be or may not be physically separated. The parts, illustrated as units, may be or may not be physical units. Namely, the parts may be located in one place, or may be distributed to multiple network units. All or some of the units can be selected according to actual needs to achieve the object of the solutions of the embodiments.

Further, each of the functional units in the respective embodiments disclosed in the present process can be integrated into one unit or may be physically separated units, and may be two or more units integrated into one unit. The integrated unit may be implemented in the form of hardware or software functional module.

If the integrated unit is implemented in the form of a software functional module and as an independent product for sale or use, the software functional module may be stored in a computer-readable storage medium. Based on this understanding, the technical solutions or the part that makes contributions to the prior art of the present invention can be substantially embodied in the form of a software product. The computer software product may be stored in one or more storage media and contain several instructions adapted to instruct computer equipment (for example, a personal computer, a server, or network equipment) to perform the methods according to the embodiments of the present invention. The storage medium comprising: a variety of medium U disk, mobile hard disk, a read-only memory (ROM), a random-access memory (RAM), a magnetic disk, or an optical disc capable of storing program code.

Those with ordinary skill in the art may understand that all or part of the steps of various methods proposed by the above embodiments can be fulfilled through relevant hardware instructed by a computer program. The program may be stored in a computer readable storage medium. The storage medium may be a flash memory, a read-only memory (ROM), a random-access memory (RAM), a magnetic disk, an optical disc and the like.

The foregoing contents are detailed description of the disclosure in conjunction with specific preferred embodiments and concrete embodiments of the disclosure are not limited to these descriptions. For the person skilled in the art of the disclosure, without departing from the concept of the disclosure, simple deductions or substitutions can be made and should be included in the protection scope of the application.

What is claimed is:

1. A method for driving a liquid crystal display, comprising:

dividing a screen of the liquid crystal display into multiple displaying regions, and performing a divisional driving to the multiple displaying regions;

setting a backlight parameter corresponding to each the displaying region of the liquid crystal display to a first backlight parameter during a first half of a time period of one frame displayed by the liquid crystal display, wherein the first backlight parameter is smaller than or equal to a maximum backlight parameter of the each displaying region of the liquid crystal display; and setting the backlight parameter corresponding to each the displaying region of the liquid crystal display to a second backlight parameter during a second half of the time period of the one frame displayed by the liquid crystal display, the second parameter is smaller than a first threshold value, to have a default frame inserted during the second half of the time period of the one frame displayed by the liquid crystal display, and a difference between a gray level of the default frame and a gray level of a full black frame is within a predetermined range.

2. The method for driving a liquid crystal display according to claim 1, wherein the step of setting the backlight parameter corresponding to each the displaying region of the liquid crystal display to the first backlight parameter, further comprises:

counting a distribution situation of a gray level of each the displaying region of the liquid crystal display, and determining the backlight parameter corresponding to each the displaying region of the liquid crystal display according to the distribution situation of the gray level of each the displaying region.

3. The method for driving a liquid crystal display according to claim 2, wherein the backlight parameter corresponding to each the displaying region of the liquid crystal display is determined according to a maximum gray level, a minimum gray level, an average gray level and a most distributed gray level of each the displaying region.

4. The method for driving a liquid crystal display according to claim 1, further comprising: performing a brightness compensation to each the gray level of the liquid crystal display, according to the backlight parameter corresponding to each the displaying region of the liquid crystal display and a brightness of each pixel of the liquid crystal display at the backlight parameter.

5. The method for driving a liquid crystal display according to claim 4, wherein the step of performing the brightness compensation to each the gray level of the liquid crystal display according to the backlight parameter corresponding to each the displaying region of the liquid crystal display and the brightness of each pixel of the liquid crystal display at the backlight parameter, further comprises:

calculating B2 according to an equation of A1*B1=A2*B2, wherein the A1 is the brightness of each the pixel at a full backlight of the liquid crystal display, the B1 is a normalized brightness of each the pixel at the full backlight of the liquid crystal display, the A2 is the brightness of each the pixel at the backlight parameter of the liquid crystal display, the B2 is the normalized brightness of each the pixel at the backlight parameter of the liquid crystal display, wherein the B1 is obtained according to the distribution situation of the gray level of each the displaying region at the full backlight of the liquid crystal display; and wherein, the method for driving the liquid crystal display further comprises:

obtaining the gray level of each the pixel of the liquid crystal display at the backlight parameter according to the B2, and driving the liquid crystal display according to the gray level of each the pixel of the liquid crystal display at the backlight parameter.

6. A system for driving a liquid crystal display, comprising:

a dividing module, for dividing a screen of the liquid crystal display into multiple displaying regions, and performing a divisional driving to the multiple displaying regions;

a first setting module, for setting a backlight parameter of each displaying region of the liquid crystal display to a first backlight parameter, during a first half of a time period of one frame displayed by the liquid crystal display, wherein the first backlight parameter is smaller than or equal to a maximum backlight parameter of the each displaying region of the liquid crystal display; and a second setting module, for setting the backlight parameter corresponding to each the displaying region of the liquid crystal display to a second backlight parameter, during a second half of the time period of the one frame displayed by the liquid crystal display, wherein the second parameter is smaller than a first threshold value, to have a default frame inserted during the second half of the time period of the one frame displayed by the liquid crystal display, and a difference between a gray level of the default frame and a gray level of a full black frame is within a predetermined range.

7. The system for driving a liquid crystal display according to claim 6, wherein the first setting module comprises:

a first counting module, for counting a distribution situation of the gray level of each the displaying region of the liquid crystal display; and a first determining module, for determining the backlight parameter corresponding to each the displaying region according to the distribution situation of the gray level of each the displaying region of the liquid crystal display.

8. The system for driving a liquid crystal display according to claim 7, wherein the first determining module determines the backlight parameter corresponding to each the displaying region, according to a maximum gray level, a minimum gray level, an average gray level and a most distributed gray level of each the displaying region.

9. The system for driving the liquid crystal display according to claim 6, further comprising:

a compensation module, performing a brightness compensation to each the gray level of the liquid crystal display, according to the backlight parameter corresponding to each the displaying region of the liquid crystal display and a brightness of each pixel of the liquid crystal display at the backlight parameter.

10. The system for driving a liquid crystal display according to claim 9, wherein the compensation module, for performing the brightness compensation to each the gray level of the liquid crystal display, according to the backlight parameter corresponding to each the displaying region of the liquid crystal display and the brightness of each pixel of the liquid crystal display at the backlight parameter, further comprises:

calculating B2 according to an equation of A1*B1=A2*B2, wherein, the A1 is the brightness of each the pixel at a full backlight of the liquid crystal display, the B1 is a normalized brightness of each the pixel at the full backlight of the liquid crystal display, the A2 is the brightness of each the pixel at the backlight parameter of the liquid crystal display, the B2 is the normalized brightness of each the pixel at the backlight parameter of the liquid crystal display, wherein the B1 is obtained according to the distribution situation of the gray level of each the displaying region at the full backlight of the liquid crystal display; and wherein, the system for driving the liquid crystal display further comprises:

obtaining the gray level of each the pixel of the liquid crystal display at the backlight parameter according to the B2, and driving the liquid crystal display according to the gray level of each the pixel of the liquid crystal display at the backlight parameter.

11. A computer readable non-transitory storage medium with a program for driving the liquid crystal display stored therein, wherein the program is executed to perform the steps comprising:

dividing a screen of the liquid crystal display into multiple displaying regions, and performing a divisional driving to the multiple displaying regions;

setting a backlight parameter corresponding to each the displaying region of the liquid crystal display to a first backlight parameter during a first half of a time period of one frame displayed by the liquid crystal display, wherein the first backlight parameter is smaller than or equal to a maximum backlight parameter of the each displaying region of the liquid crystal display; and setting the backlight parameter corresponding to each the displaying region of the liquid crystal display to a second backlight parameter during a second half of the time period of the one frame displayed by the liquid crystal display, the second parameter is smaller than a first threshold value, to have a default frame inserted during the second half of the time period of the one frame displayed by the liquid crystal display, and a difference between a gray level of the default frame and a gray level of a full black frame is within a predetermined range.

12. The computer readable non-transitory storage medium according to claim 11, wherein the step of setting the backlight parameter corresponding to each the displaying region of the liquid crystal display to the first backlight parameter, further comprises:

counting a distribution situation of a gray level of each the displaying region of the liquid crystal display, and determining the backlight parameter corresponding to each the displaying region of the liquid crystal display according to the distribution situation of the gray level of each the displaying region.

13. The computer readable non-transitory storage medium according to claim 12, wherein the backlight parameter corresponding to each the displaying region of the liquid crystal display is determined according to a maximum gray level, a minimum gray level, an average gray level and a most distributed gray level of each the displaying region.

14. The computer readable non-transitory storage medium according to claim 11, wherein the program is executed to perform the steps further comprising: performing a brightness compensation to each the gray level of the liquid crystal display, according to the backlight parameter corresponding to each the displaying region of the liquid crystal display and a brightness of each pixel of the liquid crystal display at the backlight parameter.

15. The computer readable non-transitory storage medium according to claim 14, wherein the step of performing the brightness compensation to each the gray level of the liquid crystal display, according to the backlight parameter corresponding to each the displaying region of the liquid crystal display and the brightness of each pixel of the liquid crystal display at the backlight parameter, further comprises:

calculating B2 according to an equation of A1*B1=A2*B2, wherein, the A1 is the brightness of each the pixel at a full backlight of the liquid crystal display, the B1 is a normalized brightness of each the pixel at the full backlight of the liquid crystal display, the A2 is the brightness of each the pixel at the backlight parameter of the liquid crystal display, the B2 is the normalized brightness of each the pixel at the backlight parameter of the liquid crystal display, wherein the B1 is obtained according to the distribution situation of the gray level of each the displaying region at the full backlight of the liquid crystal display; and wherein, the method for driving the liquid crystal display further comprises:

obtaining the gray level of each the pixel of the liquid crystal display at the backlight parameter according to the B2, and driving the liquid crystal display according to the gray level of each the pixel of the liquid crystal display at the backlight parameter.

* * * * *